United States Patent [19]

Ma

[11] Patent Number: 5,056,478

[45] Date of Patent: Oct. 15, 1991

[54] VARIABLE CAMSHAFT PHASING MECHANISM

[75] Inventor: Thomas T. Ma, Chelmsford, Great Britain

[73] Assignee: Ford Motor Company, Dearborn, Mich.

[21] Appl. No.: 598,739

[22] PCT Filed: May 2, 1989

[86] PCT No.: PCT/GB89/00459

§ 371 Date: Oct. 22, 1990

§ 102(e) Date: Oct. 22, 1990

[87] PCT Pub. No.: WO89/10469

PCT Pub. Date: Nov. 2, 1989

[30] Foreign Application Priority Data

Apr. 30, 1988 [GB] United Kingdom ..... 8810345

[51] Int. Cl.[5] ..... F01L 1/34

[52] U.S. Cl. ..... 123/90.17; 123/90.31

[58] Field of Search ..... 123/90.15, 90.17, 90.31

[56] References Cited

U.S. PATENT DOCUMENTS 4,858,572 8/1989 Shirai et al. ..... 123/90.15

4,903,650 2/1990 Ohlendorf et al. ..... 123/90.17

5,002,023 3/1991 Butterfield et al. ..... 123/90.17

FOREIGN PATENT DOCUMENTS 0163046 12/1985 European Pat. Off. .

2032581 2/1971 Fed. Rep. of Germany .

*Primary Examiner*—E. Rollins Cross

*Assistant Examiner*—Weilun Lo

*Attorney, Agent, or Firm*—Jerome R. Drouillard; Roger L. May

[57] ABSTRACT

A variable camshaft phasing mechanism is described comprising concentric drive and driven members (12, 10) rotatable respectively with a drive pulley (12) and a camshaft (14). The members (10, 12) are coupled to one another by means of an eccentric cranking element (18) on one of the members (12) engaged by two hydraulic jacks (28, 30) on the other member (10). Valves (36) are provided for controlling the flow of the hydraulic fluid from the chamber of the hydraulic jack (28, 20) to lock the members (10, 12) against rotation relative to one another in different relative angular positions of the members and to permit flow from either of the cylinders of the jacks to the other.

7 Claims, 2 Drawing Sheets

VARIABLE CAMSHAFT PHASING MECHANISM

Figure 1:
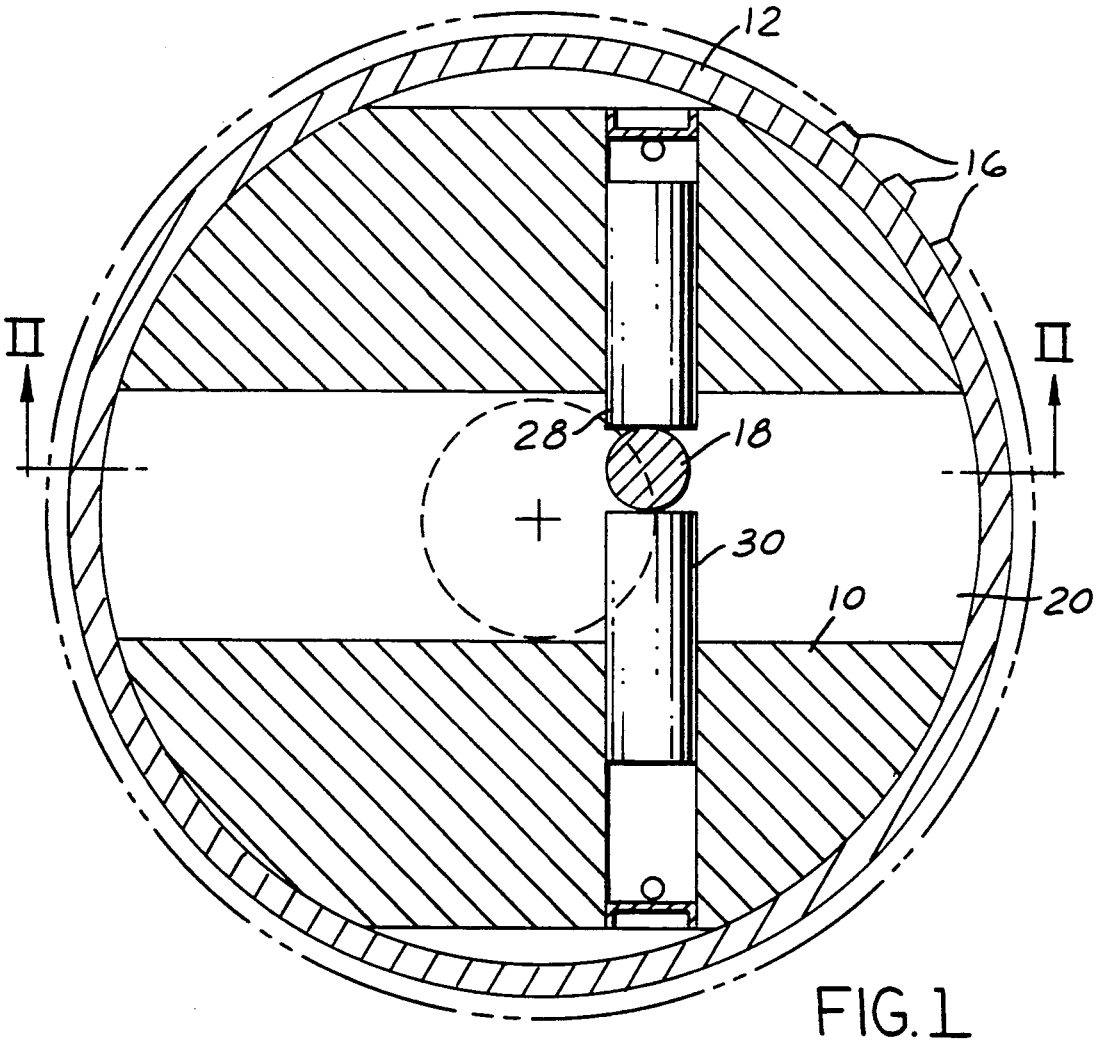

The invention relates to a mechanism for varying the phase of a camshaft of an internal combustion engine and in particular to varying the relative phase of opening and closing of the inlet and exhaust valves in a dual overhead camshaft internal combustion engine.

The optimum times for opening and closing the inlet and exhaust valves in an internal combustion engine vary, inter alia, with engine speed. In any engine with fixed angles for opening and closing the valves for all engine operating conditions, the valve timing is a compromise which detracts from the engine efficiency in all but a limited range of operating conditions. It has been proposed previously for this reason to vary the valve timing during engine operation.

In other systems, variation of the valve timing has been proposed as a means for regulating the engine output power. For example, if the inlet valve is allowed to remain open for part of the compression stroke, the volumetric efficiency of the engine can be reduced. Such a system requires an even greater range of control over the phase of the camshaft and the control needs to be continuous over the full adjustment range.

Various proposals have been made for adjustment of the camshaft phase angle relative to the crankshaft but these systems have all been complex on account of the need to withstand the considerable torque fluctuations experienced by a camshaft during normal operation. The system must also supply the force required to rotate the camshaft against the resistance offered by the valve springs which need to be compressed.

For example, it has been suggested to include a helical gear on the camshaft and to provide some form of mechanism, be it hydraulic or electro-mechanical, for axially moving the helical gear to cause the phase of the camshaft to change.

The prior art systems have therefore all involved considerable expense and many have created packaging problems on account of their size. Generally, these mechanism have only permitted a limited degree of phase adjustment, typically 15° at the camshaft, which is not sufficient for regulation of the engine output power.

Bearing in mind the cost of the phase changing mechanism and the additional load which it creates to derive the necessary power for rotating the camshaft, it has not hitherto proved generally commercially viable.

The invention seeks to mitigate at least some of the above disadvantages and to provide a variable camshaft phasing mechanism which is relatively compact, inexpensive, and does not add significantly to the engine load.

According to the present invention, there is provided a variable camshaft phasing mechanism, comprising concentric drive and driven members rotatable respectively with a drive pulley and a camshaft, the members being coupled to one another by means of an eccentric cranking element on one of the members engaged by hydraulic jacks on the other member and valve means for controlling the flow of the hydraulic fluid from the chambers of the hydraulic jacks to lock the members against rotation relative to one another in different relative angular positions of the members, characterised in that the eccentric element is tightly gripped between two hydraulic jacks acting on opposite sides of the eccentric element in order to avoid backlash, and in that the hydraulic circuit connected to the two jacks comprises a three position valve means serving to maintain the jacks isolated from one another in one position, and to provide communication between the two jacks in each of the two directions of fluid flow in each of the respective two other positions.

The use of hydraulics to alter the phase of rotation of two members is already known from GB-A-2 121 917 and GB A-2 066 986 which relate to automatic devices for advancing diesel injection pumps. Both these prior art references use two hydraulic jacks acting together to advance the phase angle and each opposed by a spring.

In the present invention, two hydraulics jacks are used to effect the phase change but they act in opposition to one another and do not require an external source of high pressure. Because of torque fluctuations on the camshaft, the symmetrical disposition of hydraulic jacks on opposite sides of the eccentric element results in the net force acting on the eccentric element being in different directions at different times in an engine operating cycle. If the phase is to remain fixed, then the valves in the hydraulic circuit prevent all fluid flow to and from the cylinders of both hydraulic jacks at all times. However, if a one-way valve is brought into operation to permit flow from one of the cylinders of the jacks to the other, then at some time in the engine cycle fluid flow will occur so that the phase will be changed intermittently in the direction of the desired setting. Depending on the direction in which the phase is to be altered, one or other of the one-way valves will be brought into operation.

Though no external source of high pressure is required, it is preferred for the hydraulic circuit to comprise a respective non-return valve connecting each jack to a low pressure fluid supply. This low pressure supply is to act solely as a top-up and does not have sufficient power to cause a phase change of the camshaft.

Conveniently, the three position valve means is a spool valve the body of which moves as the phase angle between the two members changes.

In this case, it is preferred that the body of the valve should be mounted concentrically with the camshaft and that an actuator for the valve spool should project axially from the centre of the mechanism to allow external control of the phase angle during rotation of the camshaft.

Advantageously, the body of the valve may be formed at its axial end adjacent the drive member with an end cam engaged under the action of a spring with an abutment on the drive member so that as the drive member rotates relative to the valve, the valve body is moved axially relative to the driven member.

Figure 2:
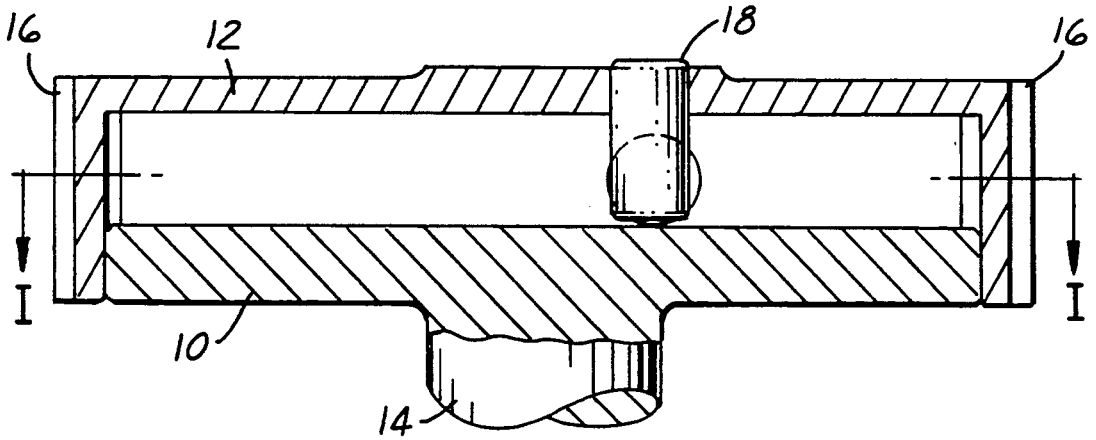
Figure 3:
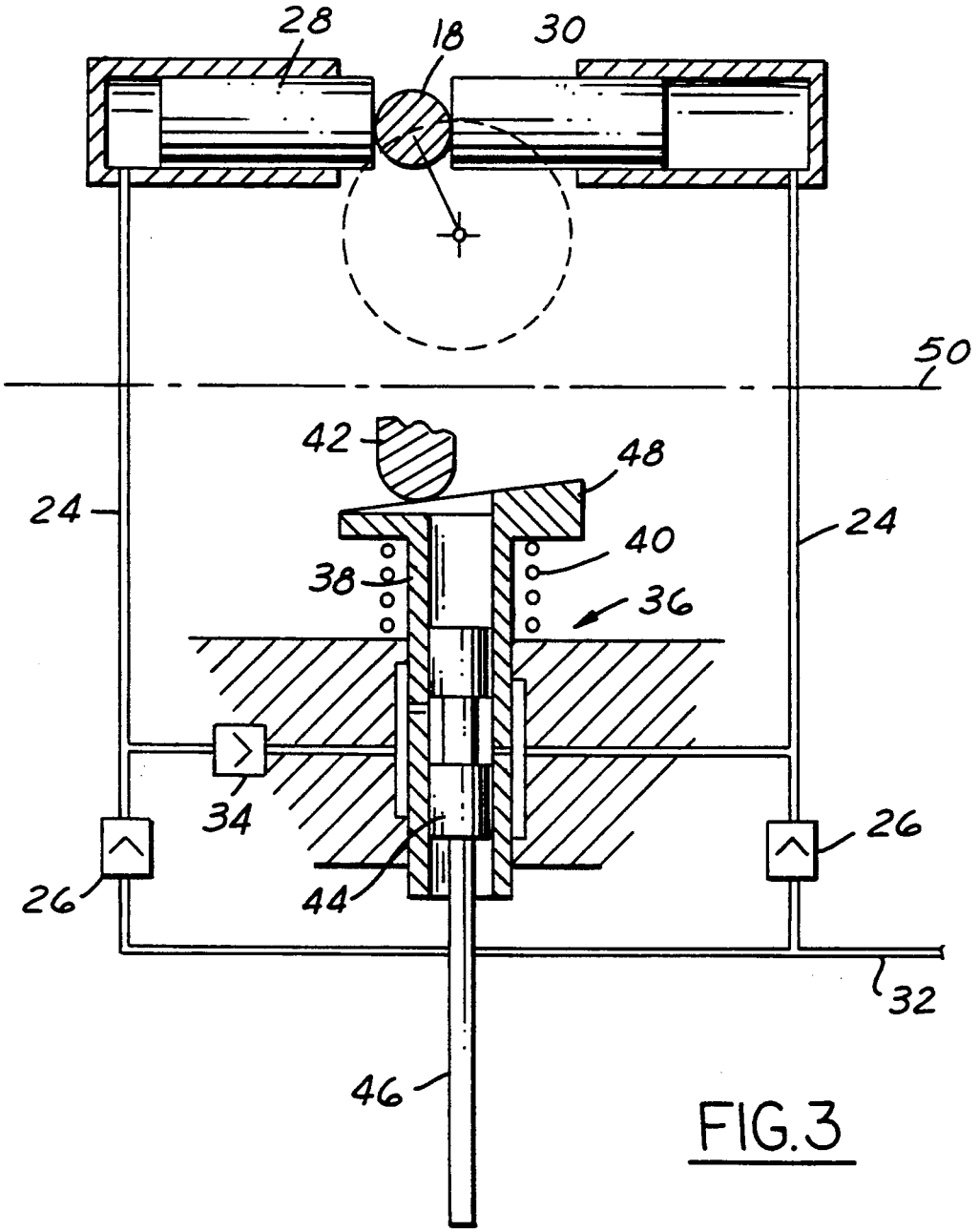

The invention will now be described further, by way of example, with reference to the accompanying drawings, in which :

FIG. 1 is a schematic section through a mechanism of the invention taken along line I—I in FIG. 2, FIG. 2 is a section along line II—II in FIG. 1, FIG. 3 is a schematic representation of the hydraulic control system for regulating the relative phase of the pulley and the camshaft.

In FIGS. 1 and 2, there is shown a variable phase shift mechanism comprising a flange 10 formed at one end of a camshaft 14 and milled with a diametrically extending recess 20. A hub 12 in the form of a hollow drum fits over the flange 10 and has an eccentric element or pin 18 received within the recess 20, the latter being significantly wider than the pin 18 to permit a large degree of movement between the hub 12 and the flange 10. The outer wall of the hub 12 carries teeth 16 and constitutes the drive pulley over which there passes the toothed drive belt for the camshaft. Of course, the hub 12 could alternatively form part of a sprocket for a drive chain or even a gear in the case of direct transmission.

The angular lost motion between the hub 12 and the flange 10 is taken up by two hydraulic jacks 28 and 30. The position of the eccentric pin 18 in the recess 20 is determined by the positions of the two pistons of the jacks and the hydraulic adjustment of the positions of the pistons in unison thus allows the phase between the hub 12 and the flange 10 to be regulated. The advantage of using two jacks acting on the pin 18 from opposite direction is that it enables all backlash to be taken up automatically and avoids any need for a linkage between the pin 18 and the face of either one of the pistons.

FIG. 3 schematically shows the hydraulic circuit for the two jacks 28 and 30. Oil pressure is supplied to each of the jacks 28 and 30 by way of a respective non-return valve 26 and a supply line 24. Thus a clamping force is developed to grip the pin 18. The lines 24 are also connected to a spool valve, which is generally designated 36.

The spool valve 36 has three ports of which two can be seen in FIG. 3 and the last is not shown as it lies out of the plane of the drawing. The central port is connected to one of the two lines 24 while the two end ports are both connected to the other line 24 but by way of non-return valves 34 which are of opposite sense to one another. In this way, in the central position of the valve spool 44 relative to the body 38 of the spool valve 36, the two jacks 28 and 30 are isolated from one another and in each end position communication is established between the two jacks, the permitted direction of fluid flow being determined by the direction of movement of the spool 44.

In the central position of the valve spool 44, no fluid can flow out of either jack and the entire mechanism is locked for rotation in unison. If the valve spool is moved to allow fluid flow from the jack 28 to the jack 30 but not in the reverse direction, then as a torque reaction builds up to rotate the pin anti-clockwise, as viewed, the piston of the jack 28 retracts and the displaced fluid extends the piston of the jack 30. This process will be repeated with each cyclic variation in torque until the piston of the jack 28 is fully retracted or the spool 44 is returned to its neutral central position. Similarly, because both positive and negative fluctuations occur in the reaction torque of the camshaft, movement of the spool 44 in the opposite direction will cause the jack 30 to be retracted and the jack 28 to be extended.

As described so far, the mechanism permits the movement of the pistons and therefore the adjustment of the phase angle without the application of an external force having sufficient magnitude to compress the valve springs. However, the control has only been able to move the pistons from one extreme position to the other and does not achieve continuous regulation. Such regulation requires phase angle dependent feedback to the valve 36.

To this end, the valve body 38 of the valve is mounted concentrically on the camshaft 14. It should be mentioned that the line 50 in the drawing schematically represents a fold line to avoid the impression that the valve and the jacks are in the same plane. The body 38 cannot rotate on the camshaft but is free to slide axially and is urged towards an abutment 42 which projects from the hub 12 by means of a spring 40. An end cam 48 on the valve body 38 acts to move the valve body 38 against the action of the spring 40 as the phase between the camshaft 10 and the hub 12 changes.

The spool 44 has a rod 46 which projects from the phase change mechanism. The position of the rod sets the position of the spool, which in turns determines the position of the valve body 38. In particular, if the valve body should not be centred on the valve spool 44, then hydraulic flow will occur to move the pistons and rotate the abutment 42 relative to the end cam 48 in the sense to return the valve body to the central position relative to the spool, where the communication between the jacks 28 and 30 is interrupted. The body 38 therefore acts as a follower to the spool and moves to cause a phase shift between the hub 12 and the camshaft 10 determined by the axial position of the valve spool 44.

The lines 24 and the lines leading to the valve 36 should preferably not be flexible to avoid the danger of leakage. To enable drilled passages to be used as hydraulic lines, in the embodiment of FIG. 3, elongate slots are used to couple the individual ports to valves 34 and the line 24 so that a connection is established in all position of the valve body 38 and the only moving elements in the hydraulic circuit are the spool 44, the body 38 and the pistons in the jacks 28, 30 all of which can readily be sealed against leakage.

In normal use, pressure is maintained by the engine lubricant circuit but no fluid is taken from the hydraulic circuit as the fluid essentially only moves from one of the jacks to the other. The external supply 32 is only called upon to provide fluid to replace minor losses which may occur through leakage. The mechanism does not therefore place any load on the engine in terms of requiring displacement of large volumes of fluid under high pressure, as was needed in prior art arrangements which resorted to external hydraulic pressure to set the desired phase shift between the camshaft and the crankshaft.

What is claimed is:

1. A variable camshaft phasing mechanism, comprising concentric drive and driven members (12,10) rotatable respectively with a drive pulley (12) and a camshaft (14), the members (10,12) being coupled to one another by means of an eccentric cranking element (18) on one of the members (12) engaged by two hydraulic jacks (28,30) on the other member (10) and valve means (36) for controlling the flow of the hydraulic fluid from chambers of the hydraulic jacks (28,30) to lock the members against rotation relative to one another in different relative angular positions of the members, characterised in that the eccentric element (18) is tightly gripped between the two hydraulic jacks (28,30) acting on opposite sides of the eccentric element (18) in order to avoid backlash, and in that a hydraulic circuit connected to the two jacks comprises a three position valve means (36) serving to maintain the jacks (28,30) isolated from one another in one position, and to provide communication between the two jacks (28,30) in each of two directions of fluid flow in each of respective two other positions.

2. A mechanism as claimed in claim 1, wherein the hydraulic circuit further comprises a respective non-return valve (26) connecting each jack (28,30) to a low pressure fluid supply.

3. A mechanism as claimed in claim 1, wherein the drive pulley (12) constitutes the member formed with the eccentric element (18), and is formed as a hub fitted over the member (10) which carries the hydraulic jacks.

4. A mechanism as claimed in claim 1, wherein the member which carries the hydraulic jacks is a flange formed integrally with the camshaft.

5. A mechanism as claimed in claim 1, wherein the three position valve means (36) is a spool valve the body (38) of which moves as the phase angle between the two members changes.

6. A mechanism as claimed in claim 5, wherein the body (38) of the valve (36) is mounted concentrically with the camshaft and an actuator (46) for the valve spool (44) projects axially from the centre of the mechanism to allow external control of the phase angle during rotation of the camshaft.

7. A mechanism as claimed in claim 5 or 6, wherein the body (38) of the valve (36) is formed at its axial end adjacent the drive member with an end cam (48) engaged under the action of a spring (40) with an abutment (42) on the drive member so that as the drive member rotates relative to the valve, the valve body is moved axially relative to the driven member.

* * * * *